US005358437A

United States Patent [19]

Allen

[11] Patent Number: 5,358,437

[45] Date of Patent: Oct. 25, 1994

[54] REVERSIBLE, LIGHTED MARKER BUOY

[76] Inventor: Lawrence J. Allen, 2020 11th Ave., E. Hibbing, Minn. 55746

[21] Appl. No.: 963,766

[22] Filed: Oct. 20, 1992

[51] Int. Cl.[5] ..... B63B 22/18

[52] U.S. Cl. ..... 441/13; 441/25

[58] Field of Search ..... 441/6, 11, 13–18, 441/21–28

[56] References Cited

U.S. PATENT DOCUMENTS

| | | | |
|---|---|---|---|
| 3,089,156 | 5/1963 | Hamm | 441/26 |
| 4,195,380 | 4/1980 | Higgs | 441/17 |
| 4,601,126 | 7/1986 | Klocksiem | 441/16 |
| 4,781,636 | 11/1988 | Schurr | 441/16 |

*Primary Examiner*—Edwin L. Swinehart

[57] ABSTRACT

A water marker buoy comprising a clear end and a brightly colored end, both ends possessing mounting studs which allow attachment to a submerged reel, the clear end being illuminated for use as a night marker and the brightly colored end being suitable for daytime marking, with the buoy having the capability of being deployed with either the clear end or the brightly colored end exposed above the water line depending upon which end is attached to the submerged reel, with the buoy being held in place by an automatic unwinding reel, which is counterweighted to prevent extra line payout, consequently rendering a more accurate location marker.

4 Claims, 4 Drawing Sheets

REVERSIBLE, LIGHTED MARKER BUOY

BACKGROUND OF THE INVENTION

The present invention relates generally to the art of marking locations on various bodies of water, and in particular to the art of buoy markers used in lakes or reservoirs. Marker buoys may be used for numerous purposes such as marking underwater hazards, navigation channels, water skiing courses, specific lakeshore locations, or spots where salvaging is to take place. Other marking techniques using various types of floating devices (such as a bleach bottle, cork float, wooden debris, etc.) anchored to the bottom in some fashion have been used in the past with variable success, but are generally considered to be inconvenient or impractical. Some fisherman attempt to use distant reference points to determine their location on a body of water through triangulation and dead reckoning, however this technique is limited to a skilled few and is difficult to use effectively. Commercially available marker buoys are used effectively for marking a desired location, but they are limited in their usefulness, in that they are intended for single purposes only.

In this art it is desirable for fisherman to maintain their position on a body of water. For fishing purposes, being at the right location on a lake or reservoir very often makes the difference between a successful fishing trip and returning home empty-handed. A common problem associated with using marker buoys is that once a marker buoy is deployed, it often attracts other fishermen to that same location, thereby creating unwanted competition for the initial fisherman. Individuals have attempted to make their marker buoys less visible by painting them black, for example, which makes the buoy less visible at a distance. However, this renders the buoy permanently less visible, and therefore unusable if the fisherman does wish to view the buoy at a greater distance.

Maintaining a position on the water is even more difficult when attempting to do so at night. For night fishing, a different sort of buoy has been used to mark one's desired location on a body of water. This has been accomplished by using a floating candle, lantern, flashlight or some other source of light to illuminate the spot where one wishes to designate a particular location. Until now, there have been no multi-purpose buoys available which are, due to their inherent reversible nature, able to serve as both a day marker buoy and a night marker buoy, as well as a less conspicuous day buoy which doesn't attract other fishermen.

The present invention represents a major advance in the art of marking a location on a body of water, since until now fisherman have not been able to select the degree of visibility of the buoy depending upon which end of the buoy they choose to expose, nor have they been able to mark their position on a lake, either day or night, with the same buoy. This invention, comprised of two ends, one clear with a light in it, and the other brightly colored, is reversible and allows fishermen to choose which end they wish to expose, depending upon the fishing conditions at the time. The reversible nature of this buoy is what separates it from other marker buoys and allows it to be used with a unique degree of flexibility.

A disclosure document has been filed in the U.S. Patent Office on Aug. 6, 1992 under receipt number 314612.

SUMMARY OF THE INVENTION

The primary advantage of the present invention is that its reversible nature allows the buoy to have multiple purposes; it may be floated with the brightly colored end exposed if high visibility is desired, or it may be floated with the clear end exposed if one wishes to mark a spot in a far less visible manner for purposes of secrecy, or if one wishes to use the built in light which illuminates through the clear end.

The general operation of the present invention is described herein to provide an understanding of the overall invention. Simply, this is a device for use by fishermen or others who desire to mark their location on a body of water both during the day as well as at night, or who wish to render their buoy less visible, and have all of these features contained in one buoy.

In the general operation of the present invention, the device is thrown into the water at the desired location and the anchor 1 i ne is automatically paid out from the reel due to the gravitational influence of the anchor. When the anchor touches bottom, further line pay out is retarded by a counterweight on the reel. The buoy is comprised of two halves, which may be divided in the center, with one end being brightly colored, and the other end being clear. Molded into each end of the buoy is a threaded stud which is used to attach the buoy to the reel bracket. This two toned buoy is attached to the reel assembly which, through the gravitational action created by the counterweighted reel, causes the buoy to float vertically, with one half of its length exposed above the water line. Depending upon which end of the buoy is attached to the reel (which thereby causes that end of the buoy to be submerged) the buoy may be deployed with the brightly colored end exposed above the water line if visibility is desired, or the clear end may be exposed if conspicuousness is a problem or if it is desired to use the light.

To illuminate the light within the buoy, the two halves of the buoy are separated by unscrewing them, thereby gaining access to the self-contained light. The cap of the light, which is normally only partially screwed onto the battery tube, is fully screwed into place, forcing the printed circuit board upon which the light emitting diode is mounted to make contact with the spring wire, thereby making contact with the negative end of the penlight batteries. As the positive end of the battery is already in contact with the center of the printed circuit board, and is continually being depressed by the screwing action of the light cap, the circuit is completed when the edge of the printed circuit board makes contact with the spring wire extending from the negative end of the batteries. Once the light is activated, the two halves of the buoy are reassembled, and the buoy is deployed in the water with the clear end exposed so the light is visible above the surface of the water. To turn the light off, the two halves of the buoy are again separated, and the light cap is unscrewed just far enough to disengage the printed circuit board from the spring wire, thereby turning the light off.

The reel assembly consists of a bracket to which the reel is assembled, and a nut which secures the reel in place, and which is tightened once the anchor line is retrieved. On one end of the reel bracket is a threaded receptacle which accepts either of the studded ends of the buoy, thereby allowing the buoy to be floated with either end exposed above the water line. The reel contains a counterweight which tends to come to rest at the bottom of its rotation, thereby resisting any further payout of line beyond the amount required to initially deploy the anchor, resulting in the buoy maintaining its position in the water without moving. The second purpose of the counterweight is that it also serves to orient the buoy in an upright position in the water, with only one half of the buoy being exposed above the water line.

A feature of the present invention is that due to its reversible nature, it may be used in the daytime as well as at night, and may also be rendered less visible during the day by deploying the buoy with the clear end being exposed above the water line.

Another feature of the present invention is its ability to resist the additional payout of line which adds to its ability to accurately mark a location on a body of water by maintaining its position.

A further feature of the present invention is that the anchor line may be retrieved through the use of a reel which allows it to be reeled in quickly with the use of the crank, without having to handle wet line.

It is anticipated that certain changes relating to the size, shape and method of construction of the present invention can be made without appreciably departing from the present invention. It is also anticipated that certain components may be joined together or integrated to offer a variety of advantages without departing from the present invention.

DETAILED DESCRIPTION OF THE PREFERRED EMBODIMENT

Figure 1:
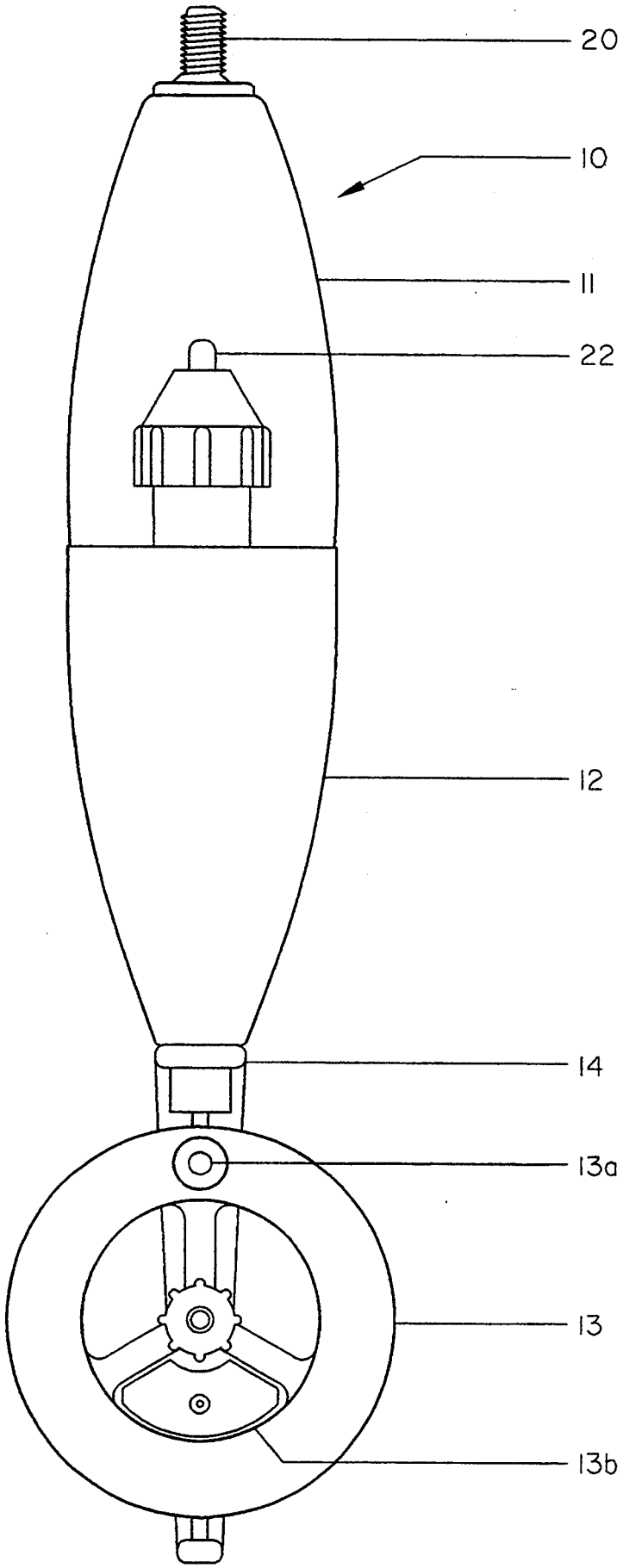
FIG. 1 is an elevation view of the present invention fully assembled.

The present invention herein is generally described as a marker buoy, 10, which referring to FIG. 1, consists of three parts. The clear end, 11, the brightly colored end, 12, and the reel assembly, 14, which contains the reel, 13, crank, 13*a* and counterweight, 13*b*. These parts make up the marker buoy and are set up to easily receive one another. The clear and colored ends each possess a threaded stud, 20 which is an integral part of each end, and allows the buoy to be deployed with either end attached to the reel assembly, thereby exposing only one end or the other above the water line.

Figure 2:
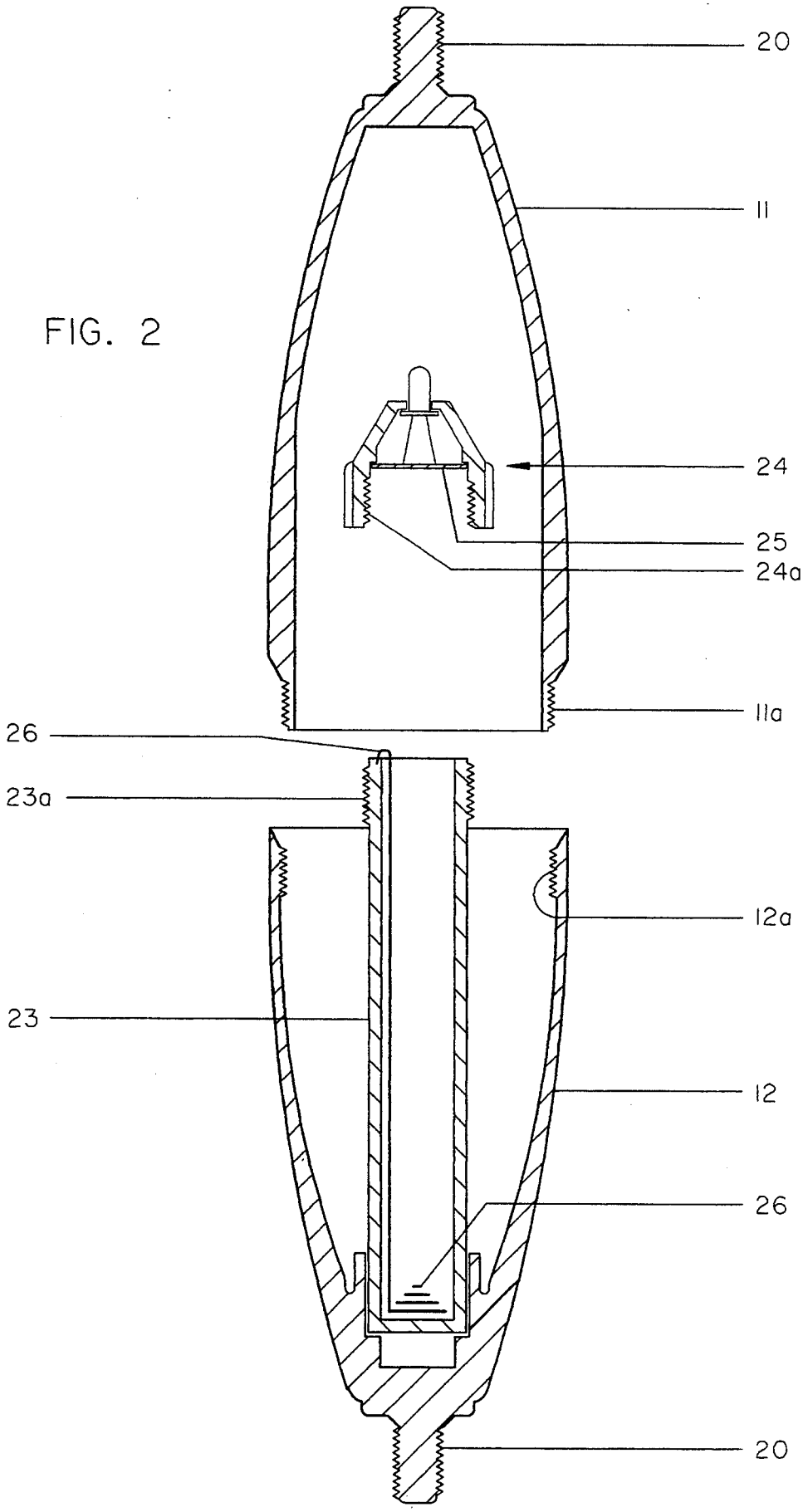
FIG. 2 is an exploded view of the preferred embodiment of the present invention.

Referring to FIG. 2, the clear end is further distinguished from the colored end by a light, 22, which is an integral part of the colored end, 12, and extends into the clear end, 11. The colored end possesses a battery tube, 23, which is an integral part of the colored end, 12. The marker buoy can be disassembled and batteries can be inserted into the battery tube, 23. Then the light cap, 24, can be assembled onto the end of the battery tube 23. The light, 22, will be energized when the light cap is engaged fully with the battery tube, thereby bringing printed circuit board, 25, in contact with the top end of wire spring, 26, and it will be de-energized when only partially engaged with the battery tube.

The clear end, 11, fits into the colored end, 12, by threaded connection 11*a* and 12*a*. The light cap, 24, fits onto battery tube, 23, by threaded light connection, 24*a* and 23*a*.

Figure 3:
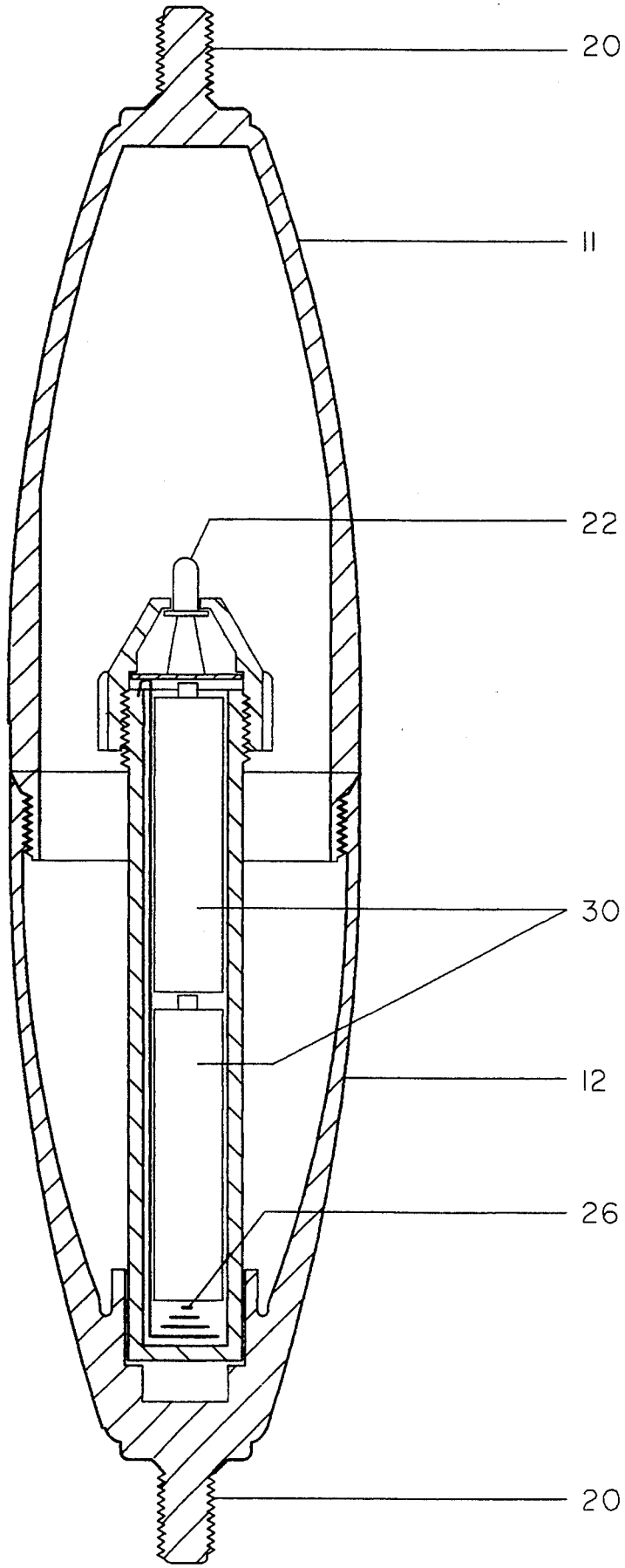
FIG. 3 is a cross sectional view of the buoy float body of the present invention.

Referring to FIG. 3, Batteries, 30, are held in electrical contact with light, 22, by action from spring, 26. When the light is energized, it illuminates the clear end of the marker buoy. This is useful as a night marker. The buoy is separated by unscrewing the two halves, the light de-energized, and the colored end may then be made visible by reversing the buoy so the clear end is submerged by attaching it to the reel assembly, 14.

Figure 4:
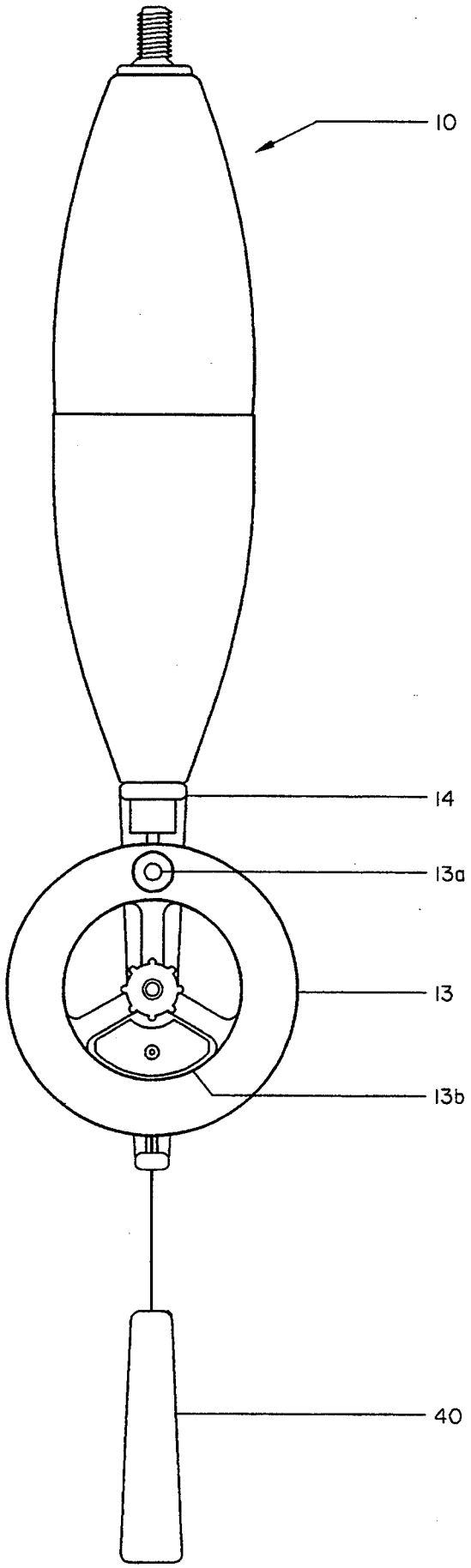
FIG. 4 is a multiple view of the present invention as it would be used.

Referring to FIG. 4, one of the threaded ends of the buoy is screwed into the reel assembly, 14. Also attached to the reel assembly is the reel, 13, which includes a crank 13*a*, and counterweight, 13*b*. The marker buoy can simply be thrown overboard in any position and buoyancy action versus gravity will always orient it upright. The weight of the anchor, 40, causes it to pay out line. When the anchor comes to rest on the lake or ocean bottom, the effect of the counterweight works to retard and prevent additional pay out of line, consequently holding the marker buoy accurately in one location. FIGS. 4*a*, 4*b*, and 4*c* show the progressive rotation of the reel with the counter-rotational action of the counterweight being demonstrated.

Now that the invention has been described, that which is claimed is:

1. A water marking buoy comprising an automatic unwinding line reel with said reel possessing two flanges, with said reel flanges being connected centrally by a medial portion upon which an elongated anchor line is flexibly wound, with one end of said elongated anchor line being attached to said medial portion of said reel and the other end of said elongated anchor line being attached to an anchoring device, with said reel rotatably mounted upon a reel mounting bracket so configured as to allow the free dispersal of said elongated anchor line through an aperture of a greater diameter than that of said elongated anchor line, with said aperture being located in the distal end of said reel mounting bracket and so placed as to guide said elongated anchor line on to and off of said reel, with said reel having an additional weight attached to either one or both reel flanges, with said additional weight being peripherally disposed in a concentrated area of only one hemisphere of said reel flange(s), one half of said reel resultingly being substantially heavier than the other due to the attachment of said peripherally mounted weight, with said reel being mounted upon said reel mounting bracket on its medial axis so as to allow the unencumbered rotation of said reel about its medial axis, thereby allowing said peripherally attached weight to influence the rotation of said reel about its medial axis, whereby said peripherally attached weight gravitationally tends to position said reel in a naturally resting location at the bottom of said reel's rotation about its medial axis due to the gravitational forces being exerted upon said peripherally attached weight, thereby restraining any further rotation of said reel.

2. The device of claim 1 wherein said water marking buoy is comprised of a hollow ellipsoid shaped main body which is threadingly attached to said reel mounting bracket, with said ellipsoid shaped main body being itself threadingly separable along its medial plane into two hollow buoy halves, each buoy half describing one half of an ellipsoid shape, with one buoy half being transparent and the other buoy half being opaque, wherein said opaque buoy half contains a detachable battery housing which is removeably secured to a mounting socket formed by the inner contours of said opaque buoy half.

3. The device of claim 2 wherein said detachable battery housing is comprised of a hollow, cylindrically shaped body with one end opened and threaded to receive a light retaining cap which is threadingly attached to said cylindrically shaped body, with said light retaining cap containing a light emitting diode, wherein said light emitting diode is secured through soldering or other electrically conductive means to a printed circuit board, with said light emitting diode bearing printed circuit board being removeably secured within said light retaining cap in such a way as to allow said light emitting diode to protrude through a circular opening located in one end of said light retaining cap, said battery housing being removeably positioned in said mounting socket contained within said opaque buoy half so as to be projected substantially beyond the confines of the hollow interior space of said opaque buoy half, thereby allowing said light emitting diode to be visible through said transparent buoy half when said two buoy halves are assembled together and are viewed on a plane perpendicular to said buoy's longitudinal axis.

4. The device of claim 3, wherein said light emitting diode is energized by threadingly tightening said light retaining cap onto said battery housing, wherein the threadingly tightening of said light retaining cap brings said light emitting diode bearing printed circuit board contained therein into electrical contact with the batteries contained within the battery housing, with the de-energizing of said light emitting diode being accomplished through the threadingly loosening of the light retaining cap from the battery housing, thereby disconnecting said light emitting diode bearing printed circuit board from said batteries.

* * * * *